United States Patent [19]

Ball et al.

[11] Patent Number: 4,771,583

[45] Date of Patent: Sep. 20, 1988

[54] SPACE DIVIDER SYSTEM

[75] Inventors: Douglas C. Ball, Ste-Anne-de-Bellevue; William Stumpf; Gary Ludwig, both of Kitchener, all of Canada; Marshall Walker, Rancho Palos Verdes, Calif.

[73] Assignee: Hauserman, Inc., Cleveland, Ohio

[21] Appl. No.: 791,357

[22] Filed: Dec. 4, 1985

Related U.S. Application Data

[63] Continuation of Ser. No. 81,437, Oct. 3, 1979, abandoned.

[51] Int. Cl.[4] ..... H02G 3/00; E04H 1/00

[52] U.S. Cl. ..... 52/221; 50/239; 174/48

[58] Field of Search ..... 52/220, 221, 239; 174/48, 49; 312/239, 198, 208, 237; 160/135, 351, 127; 211/177, 189, 180; 439/115

[56] References Cited

U.S. PATENT DOCUMENTS

| | | | |
|---|---|---|---|
| 1,048,256 | 12/1912 | Wolf | 52/303 |
| 3,160,244 | 12/1964 | Kushner | 52/238 |
| 3,195,698 | 7/1965 | Codrea | 52/239 |
| 3,274,741 | 9/1966 | Neagle | 52/242 |
| 3,289,368 | 12/1966 | Mark | 52/239 |
| 3,471,629 | 10/1969 | O'Leary | 174/49 |
| 3,809,142 | 5/1974 | Bleecker | 160/135 |
| 4,032,821 | 6/1977 | Keiser | 174/48 |
| 4,129,163 | 12/1978 | Johnson | 52/239 |
| 4,239,932 | 12/1980 | Textoris | 52/179 |
| 4,360,705 | 11/1982 | Rogers | 174/48 |

*Primary Examiner*—John E. Murtagh

*Attorney, Agent, or Firm*—Renner, Otto, Boisselle & Sklar

[57] ABSTRACT

An improved and more versatile space divider system for open office interiors includes as a major component a structure beam or spine supported at each end by vertically adjustable legs. Feet on the legs provide the required lateral stability to support or hang components such as work surfaces, filing systems and the like from the beam. Each beam includes two enclosed electrical ducts on the top thereof superjacent work surface height, such ducts being provided for power and communication wiring respectively, with the latter being above the former and laterally enlarged. The power wiring duct is prewired with outlets on both sides, while the communications wiring duct includes both lateral and top access. The legs have a smooth exterior surface yet permit beams to be connected thereto at a wide variety of angles. Enclosures or fillets for the beams and legs permit the ducts to pass through the legs fully enclosed. Each beam may be provided with a midpoint connection so that one beam may be connected to and extend normal to the other without a leg beneath the point of connection. Posts extend upwardly from the beam from which hanger bars are secured for supporting further accessories or acoustical panels. Accessories such as work surfaces may quickly hook onto a recessed hook channel in the beam, such accessories having a movable locking tab to secure the hook edge to the beam.

41 Claims, 7 Drawing Sheets

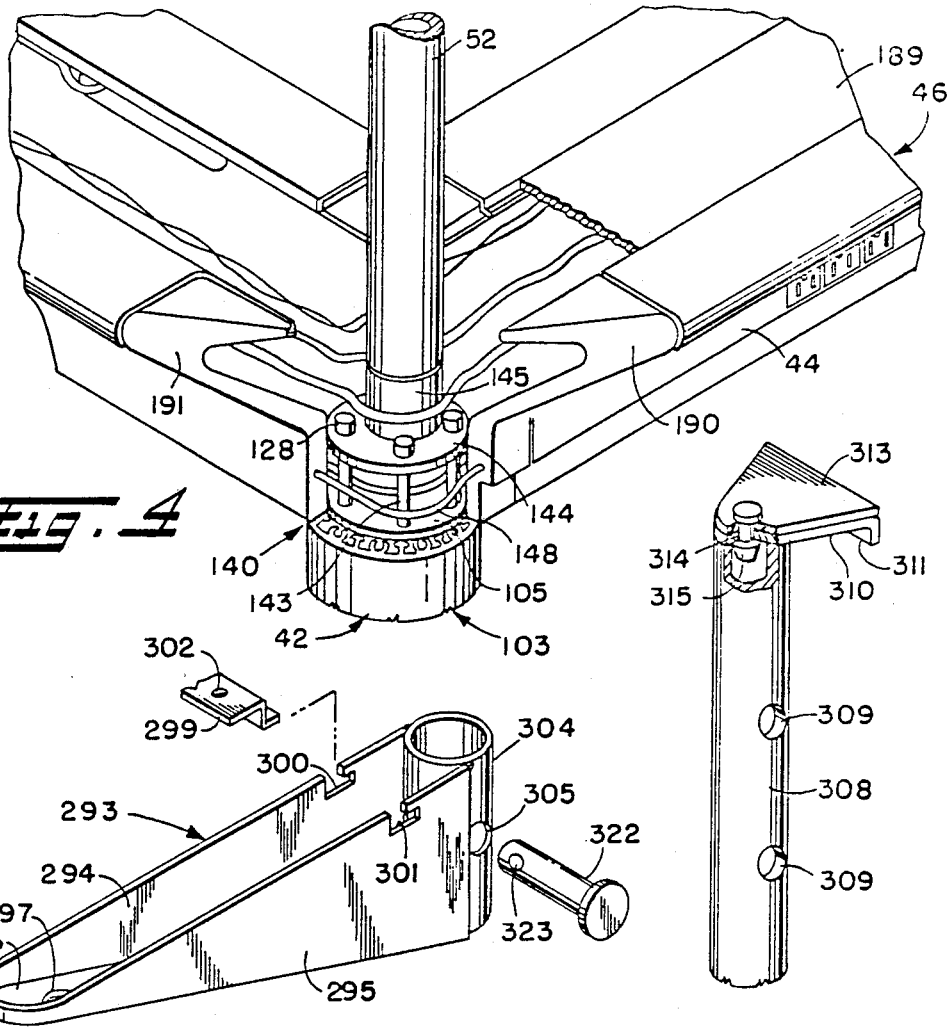
Fig. 4
Fig. 16
Fig. 15
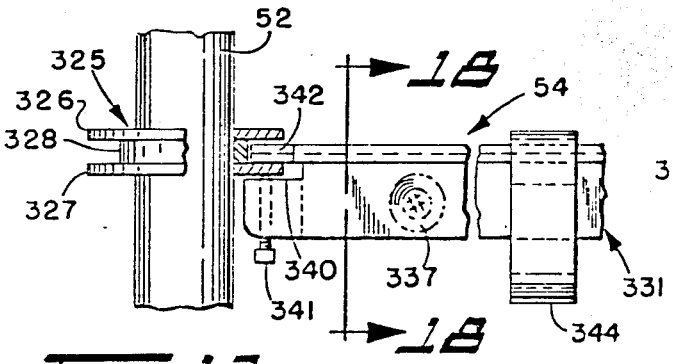
Fig. 17
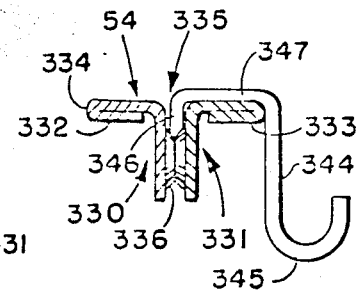
Fig. 18

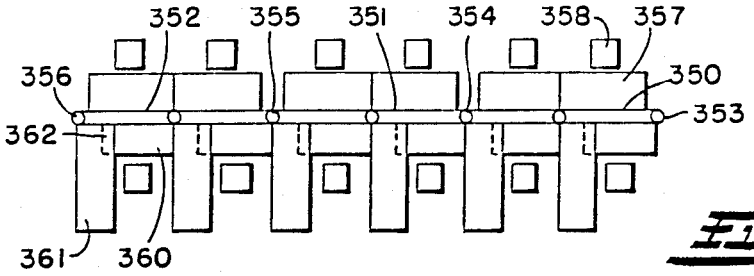
Fig. 25
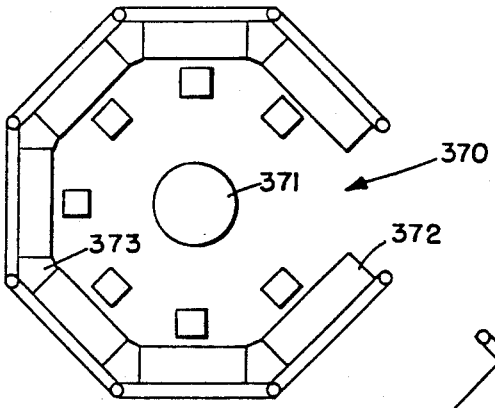
Fig. 26
Fig. 27
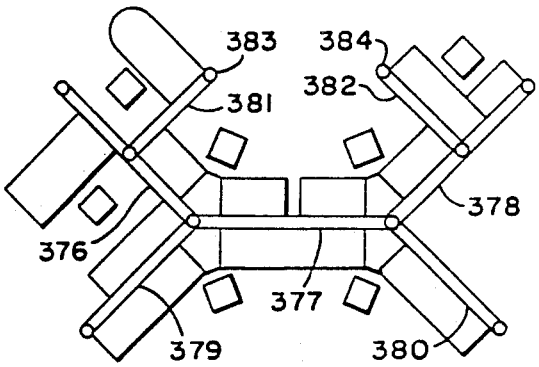
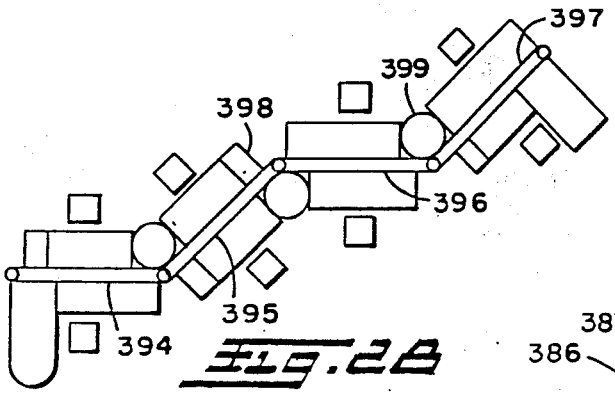
Fig. 28
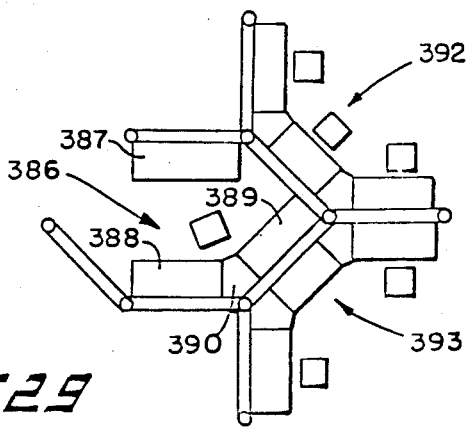
Fig. 29

SPACE DIVIDER SYSTEM

This is a continuation pending application Ser. No. 081,437 filed on Oct. 3, 1979 now abandoned.

This invention relates generally as indicated to a space divider system and more particularly to certain improvements in a space divider system of the type disclosed and claimed in the copending application of Douglas C. Ball and Marshall Walker, Ser. No. 914,713 now U.S. Pat. No. 4,224,769, filed June 12, 1978, entitled SPACE DIVIDER SYSTEM.

BACKGROUND OF THE INVENTION

In such prior copending application there is disclosed a unique space divider system for open office interiors, the major component of which is a structural beam supported from posts at each end stabilized by projecting feet. The beam itself constitutes a wiring raceway and includes a raceway on the top thereof open through a lateral slot above work surface height. The posts or legs for the beam are provided with apertures or mounting brackets to which the ends of the beam are connected. The mounting brackets project from the surface of the post and different post configurations are required depending upon the number of beams connected to the post.

In modern office interiors, the use of power driven machines is rapidly increasing. Moreover, communications systems are becoming quite complex and the management of power and communication wiring in a modern office is a significant and continuing problem. Many codes require fully enclosed wiring ducts. For simplicity, both communication and power wiring should be available superjacent work surface height and readily available to work surfaces or stations such as word processing stations or computer terminals.

Also, for cost effectiveness, it is important to provide the required wire management for energy and communications requirements while still providing a high degree of horizontal and vertical flexibility with commonly used components thus reducing the overall cost.

SUMMARY OF THE INVENTION

The system of the present invention provides fully enclosed communications and power wiring ducts superjacent the work surface on top of a supporting spine or structural backbone to enable effective use of the increasing number of machine and communication devices found in the modern office. In addition, the system provides a wide variety of options in the enclosure of space providing a very high degree of both horizontal and vertical flexibility.

The major component of the system is a structural beam which may come in a variety of lengths supported by posts at each end. Lateral stability, where required, is provided by projecting feet which extend from one or both sides of the posts. The beams are provided with an optional midpoint connection which may be used further to divide the beam module. The height of the beam including the integral wiring ducts on the top thereof may be adjusted vertically and the work surfaces supported by the beam may be adjusted with respect to the beam within a certain range.

The two ducts on the beam are fully enclosed with the duct for the communication wiring being above the duct for the power wiring and also being laterally enlarged. The power wiring duct is prewired with outlets on both sides while the communication wiring duct may include both lateral access and also top or lay-in access.

The leg supporting the beams have a smooth exterior surface that permit the beams to be connected thereto at a wide variety of angles. Accordingly, only a single leg construction need be provided regardless of the angular position of the beams extending therefrom. Enclosures or fillets for the beams and legs permit the ducts to pass through the legs fully enclosed. The power wiring passes through a cage on the top of the leg while the communication wiring passes around a reduced diameter post extension, if employed. Enclosures for the top of the leg facilitate the wiring bypass of the leg.

As indicated, each beam may be provided with a midpoint connection so that one beam may be connected to and extend normal to another beam without a leg beneath the point of connection. Again fillets are provided to insure that the ducts are enclosed from beam to beam.

Above the ducts, extensions of the leg or posts are provided from which hanger bars may be secured for supporting further accessories or acoustical panels. Wiring to the ducts may enter the system from the floor or ceiling adjacent the legs or through post extensions, respectively.

Accessories such as work surfaces are provided quickly to hook into a recessed hook channel in the beam, such accessories having a movable locking tab. In one position the locking tab acts to maintain the hook of the accessory in the channel while the other position of the tab permits the insertion and removal of the hook.

The assembly of the legs and beam is accomplished in a few minutes with very simple tools. The beams may be added to or removed from the system with no disturbance to the rest of the system.

A system of quarter-circle castings is employed to enclose the wiring at the beam and leg connections and the same or similar castings are employed in a variety of combinations for all beam connections. The aforementioned mid-beam connection may use the same fastening points as the post connection and accordingly, the beam module may either be connected to a post at the selected angle or to a mid-beam connection.

It is accordingly a principal object of the present invention to provide a space divider system utilizing common modules which may be interconnected in wide variety to provide both the horizontal and vertical flexibility desirable in an open office space divider system.

Another principal object is the provision of a space divider system which employs enclosed electrical ducts superjacent work surface height.

Still another important object is the provision of such system which provides separately enclosed ducts for both power and communication wiring.

Still another object is the provision of such system wherein the communications wiring duct is above the power duct and includes top or lay-in access.

Yet another important object is the provision of a beam and leg system as indicated wherein the beam may be connected to the leg at a wide variety of angles.

Still another important object is the provision of such system wherein beams may be connected to beams.

A further object is the provision of a system as indicated wherein the legs supporting the beams have a smooth exterior surface yet permit the beam to be connected thereto at a wide variety of angles.

A further object is the provision of such system wherein enclosures or fillets are provided for the beam and legs to permit the ducts to pass through the legs fully enclosed, while imparting to the legs a compatible and pleasing shape.

Still another object is the provision of a system which includes an accessory receiving hook channel to which accessories may quickly be connected.

Another object is the provision of accessories for such system such as work surfaces which may be quickly hooked into the recessed hook channel, such accessories including a movable locking tab to secure the hooked edge to the beam.

Other objects and advantages of the present invention will become apparent as the following description proceeds.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principle of the invnetion may be employed.

BRIEF DESCRIPTION OF THE DRAWINGS

In said annexed drawings:

FIG. 4 is a perspective broken away view illustrating the wiring access passages through the leg for a 90° beam connecting;

FIG. 15 is a broken enlarged perspective view of a desk top support bracket used with the present invention;

FIG. 16 is an exploded view broken away illustrating the manner in which the desk top is secured to the bracket;

FIG. 17 is a detail broken away and in section of the manner in which hanger bars are secured to post extrusions;

FIG. 18 is a detail section of the hanger bar illustrating a storage component hook received therein;

FIGS. 24–29 are schematic top plan views of some of a variety of layouts which may be formed with the present invention.

DESCRIPTION OF THE PREFERRED EMBODIMENTS

Figure 2:
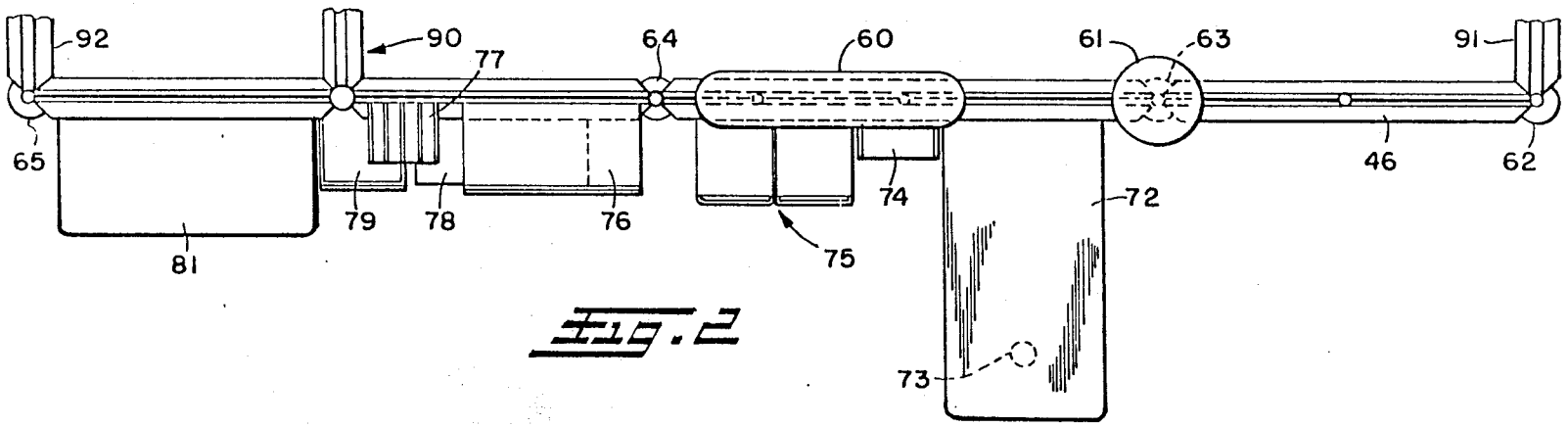
FIG. 2 is a top plan view of the system of FIG. 1 as seen from the line 2—2 thereof.
Figure 1:
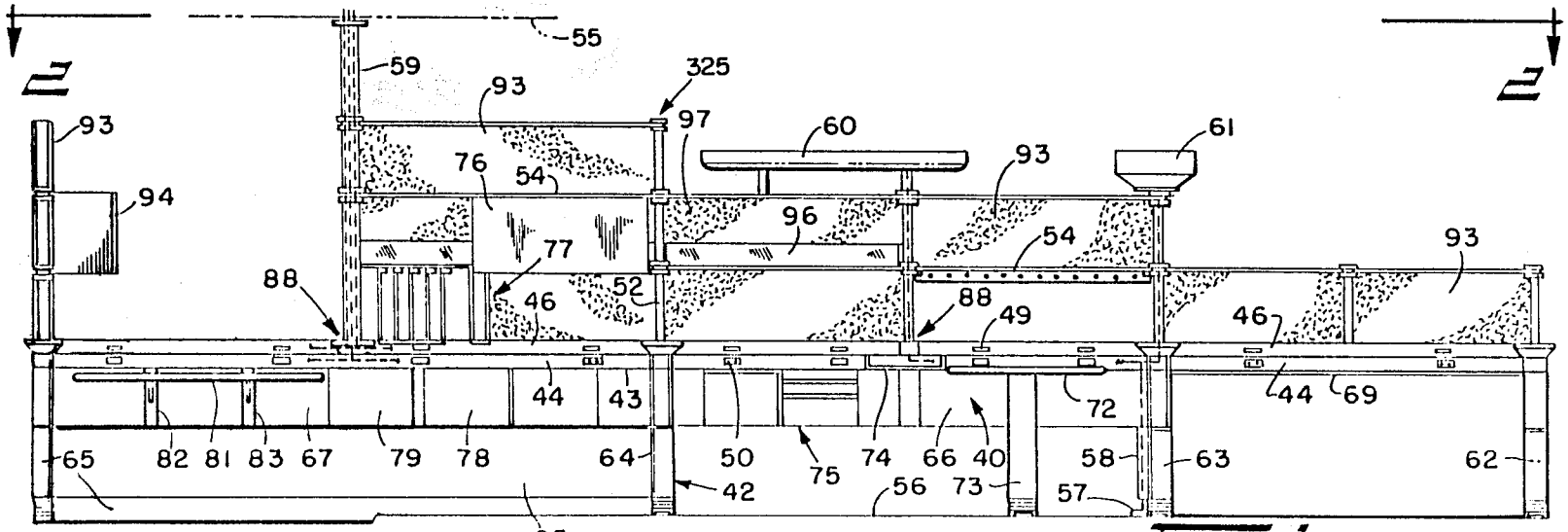
FIG. 1 is a side elevation of a space dividing system in accordance with the present invention.

Referring first to FIGS. 1 and 2 it will be seen that the components of the space divider system may be used to support a wide variety of components or accessories such as desk tops, both cantilevered and leg supported, shelves, storage compartments, paper organizers, drawers and files, light fixtures, sound absorbing panels or cushions, or window slots.

The major component of the system is a horizontally extending beam seen at 40 which may be provided in a variety of length modules. The beams are supported at each end by legs 42 or one beam may be connected to another beam at a beam midpoint as hereinafter described. The top of each beam as indicated at 43 is designed to be substantially at work surface height and on top of the beam superjacent such work surface height are two enclosed electrical ducts seen at 44 and 46, one on top of the other accomodating power and communication wiring, respectively. The top communications wiring raceway 46 is laterally enlarged and includes a top access cover 48 so that communications wiring may be laid into the top of the raceway 46. Both raceways may be provided with lateral outlets seen at 49 and 50. The power raceway 44 is preferably prewired and the lateral access thereto is provided through conventional outlet 50.

The legs, as hereinafter described, include horizontal access or passageways for both wiring ducts and such legs may support post extensions 52 extending above the ducts between which are connected hanger bars 54 from which the various upper components of the present invention may be secured.

Wiring to the ducts may originate either in the ceiling 55 or the floor 56. If wiring originates in the floor as indicated at 57 it may extend to the ducts through wiring covers 58 secured to the exterior of the leg. If it originates in the ceiling 55 it may extend through slightly enlarged tubular post extensions 59.

The post extensions 52 are hollow and may also be employed to support lighting fixtures 60 and 61 providing ambient lighting.

In the particular linear system seen in FIGS. 1 and 2, reading from right to left, there is shown four such legs 42 as seen at 62, 63, 64 and 65. The legs 63 and 64 as well as 64 and 65 are interconnected by beams 40 of different length modules as seen at 66 and 67. The legs 62 and 63 are interconnected by a relatively short module length of ducts 46 and 44 which are supported on a relatively shallow channel or frame spanning the legs 62 and 63 and connected thereto in much the same manner as the beams as hereinafter described. Because of the employment of the duct only between the legs 62 and 63 and the lack of a structural beam, components such as desk tops, storage units and the like cannot be supported from the divider system at such point.

Extending from the top edge of the beam 66 is a table or desk top 72 which is supported from the beam by a hook received and a recessed hook channel and at its distal end by a single vertically adjustable leg 73 similar in appearance to the leg 63. It is noted that the outlets for both the electrical and communication ducts are immediately superjacent the work surface of the desk or table 72.

Adjacent the table 72 a relatively small tray or work surface seen at 74 projects from the beam which can be used as a paper tray or to receive a telephone or small dictating machine, for example. Adjacent the tray 74 is a two-unit drawer system seen at 75 which extends in cantilever fashion from the beam 66.

Moving to the next module, suspended from the second rail 54 is an overhead storage unit or cabinet 76. A paper organizer or compartmental filing system may be suspended and project from the next lower horizontal rail as seen at 77. Cantilevered from the beam 67, storage bins seen at 78 and 79 may be provided. Adjacent the bin 79 there is secured to the beam 67 a cantilever work surface 81 which is supported on brackets 82 and 83 secured to the beam in a manner hereinafter described. Again the top of the work surface has the outlets from the wiring ducts 46 and 44 immediately there above.

It is noted for illustration purposes only that the floor 56 beneath the leg 65 is somewhat lower than the floor beneath the leg 64. Because of a height adjustment incorporated in the legs, the beam 67 can nonetheless be positioned horizontally. Extending between the legs 64 and 65 is a fill panel 85 which may, if desired, extend all the way to the floor with the lower edge compensating for floor irregularities. The cantilevered tops such as desk top 81 may themselves be provided with a vertical adjustment with respect to the beam and the beam itself may be vertically adjusted through a somewhat more narrow range to compensate for not only the floor irregularities noted, but also to raise or lower the height of the beam.

Each beam is provided with an optional midpoint connection as seen at 88 with the midpoint connection of the beam 67 being utilized while the midpoint connection of the beam 66 is not. When utilized, a further beam seen at 90 may be connected to the midpoint of the beam to extend normal thereto. In such situation, there is no leg supporting the midpoint of the beam 67 or the end of the beam 90. Additional beams seen at 91 and 92 may be connected to the leg 62 and 65, respectively with the upper structure supporting either acoustical panels seen at 93 or overhead storage cabinets seen at 94. The cabinets 94 and 76 may be the same. The acoustical panels or cushions 93 are supported from the rails 54 and serve not only visually to block the area above the beams and ducts, but because of their structure utilizing fabric over cushion material, they serve as visually soft sound absorbing or sound deadening panels. Such panels may vary in shape and as indicated at 95 and 96 window slots may be provided below somewhat more narrow acoustical panels 97.

In the illustrated embodiment the superstructure provided by the post extensions 52 and rails 54 may provide three levels. Preferably only the first two levels are used for shelf or storage component loads while the third level is used only for acoustical panels or non-eccentric loading such as provided by the ambient lights 60 and 61.

Leg-Beam Connection

Figure 3:
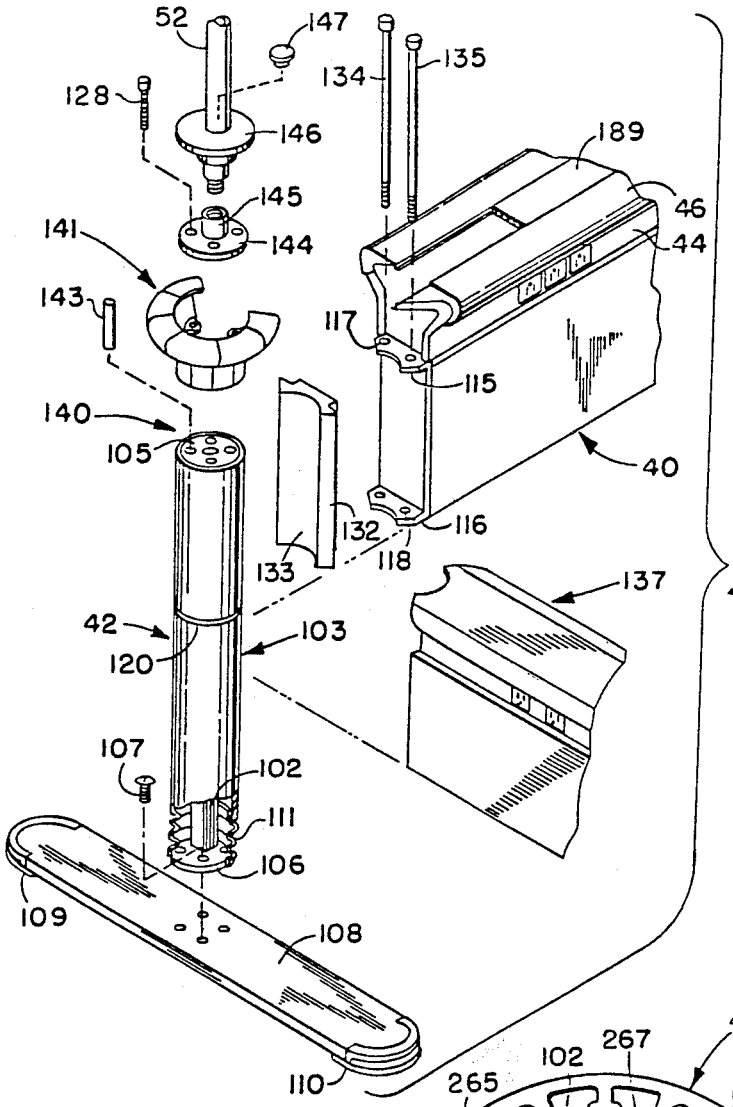
FIG. 3 an exploded view in perspective and broken away of the beam-leg connection of the present invention.
Figure 7:
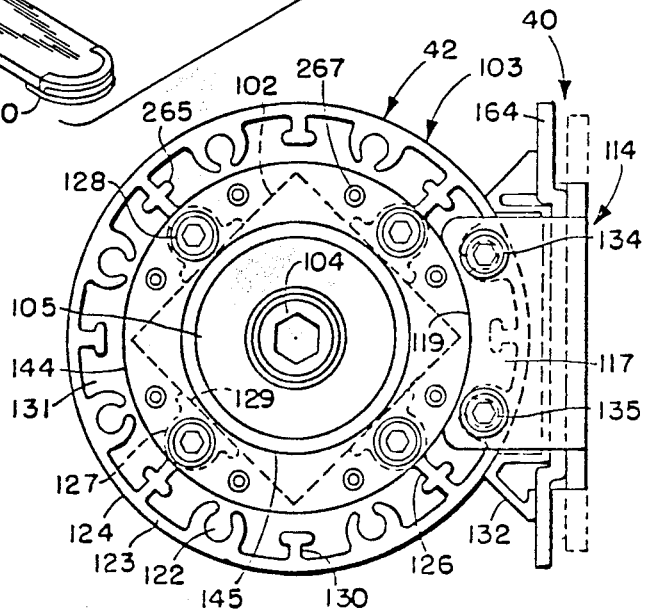
FIG. 7 is an enlarged top plan view of the beam-to-leg connection.

Referring now to FIGS. 3 and 7 it will be seen that the main structural component of the leg 42 is a vertically extending square tubular post 102 surrounded by an extruded aluminum cylindrical sleeve 103. The top of the post 102 is provided with a nut into which a flanged leveling screw 104 is threaded, with the flange supporting circular disc or plate 105 secured to the top of sleeve 103. The diameter of the top plate or disc 105 is somewhat smaller than the outside diameter of the sleeve and in any event by rotating the adjusting screw 104 the vertical position of the sleeve on the post may be altered as indicated.

The bottom of the post is provided with a further disc 106 which is secured by fasteners 107 to a foot 108. Glides 109 and 110 may be provided beneath each end of the foot to facilitate movement over floor surfaces such as carpeting. A flexible bellows 111 provides an appearance cover or closure between the variable lower end of the sleeve 103 and the foot 108.

The end of each beam 40 is provided with a rigid vertically enlarged clevis seen at 114 which includes projecting top and bottom ears 115 and 116. The top ear is provided with two through holes 117 while the bottom ear is provided with tapped through holes 118. The projecting end of the ears is provided with an arcuate edge as seen at 119 corresponding to the O.D. of the disc 105. The top ear is designed to fit over the top of the sleeve 103 snugly adjacent the O.D. of the disc as seen more clearly in FIG. 7 while the bottom ear 116 fits within slot 120 in the sleeve 103. The slot 120 is of the same depth as the O.D. of the disc 105.

As seen more clearly in FIG. 7, the sleeve 103 includes a total of eight equally spaced vertically extending holes on the inside of the outer shell or cylinder 123. The exterior of such cylinder from the top to the bottom of the sleeve, with the exception of the slot 120, is a smooth circular cylindrical surface. The sleeve also includes four inwardly extending vertical quadrant spaced webs 126 which terminate in enlarged bosses 127 providing holes for fasteners 128, such bosses each including laterally enlarged flat vertical surfaces 129 bearing and sliding against the four flat faces of the square post 102. The sleeve may be provided with additional internal rigidifying ribs as seen at 130. The ribs 130 and webs 126 form upwardly facing recesses 131 with the bosses for holes 122 which facilitate the positioning of leg enclosures as hereinafter described.

It is noted that the holes 122 in the sleeve exposed both at the top of the sleeve and through the slot 120 are eight in number and equally circumferentially spaced about the sleeve. The spacing of adjacent holes is also equal to the spacing of the holes in the top and bottom ears of the clevis 114. Thus to secure the beam 40 to the post, a spacer 132 is inserted between the ears providing a visual and sound seal. The spacer is provided with an interior arcuate surface riding against the O.D. of the sleeve. The beam is then inserted with the top ear 115 over the top of the sleeve and the bottom ear 116 in the slot 120. Elongated fasteners seen at 134 and 135 then extend downwardly through the holes 117, the selected holes 122, and are threaded into the holes 118 in the bottom ear not only to pin connect the beam to the sleeve but also to clamp the beam to the sleeve.

An additional beam as seen at 137 may also be connected to the leg and if at right angles as illustrated, the beam would be similarly connected to the two holes 122 at the bottom of FIG. 7.

The electrical ducts 44 and 46 which are stacked one on top of the other on top of the beam 40 are provided access through or around the leg by means of a cage 140 and leg enclosures 141. The cage 140 is perhaps seen more clearly in FIG. 4. The cage is simply a transverse opening through the leg as provided by spacers 143 through which the fasteners 128 pass. The spacers vertically space the disc 105 on the bottom from the disc 144 of the post extension socket 145 on the top. The post extension 52 is then simply threaded into the socket 145 through circular leg cap 146. If the post extension is not employed, the hole in the circular leg cap may be closed by cover or plug 147. As seen more clearly in FIG. 4, four such fasteners 128 and spacers 143 are employed to form the cage opening through the leg, such cage being at the same elevation and forming a continuation through the leg of the lower electrical duct 44.

The lower duct is preferably prewired and junction boxes may be provided in the beams adjacent the legs with flexible jumpers connected therebetween as seen at 148 in FIG. 4.

The Beam

Figure 5:
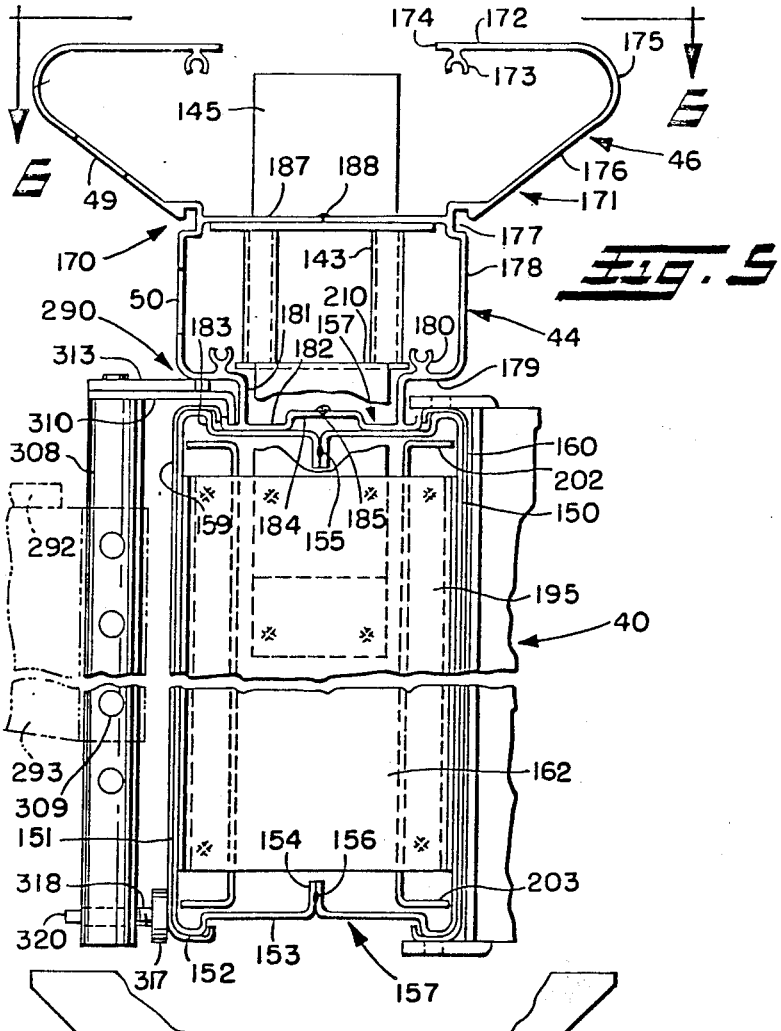
FIG. 5 is an enlarged vertical section through the beam illustrating the manner in which desk tops and the like are supported from the beam.
Figure 6:
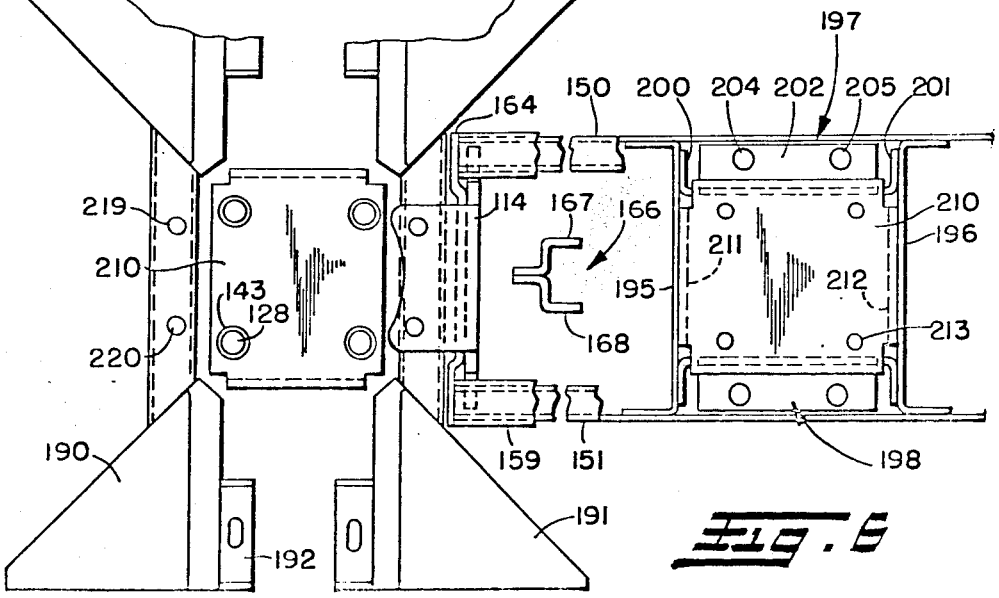
FIG. 6 is a top plan view broken away of the mid-beam-to-beam connection.
Figure 8:
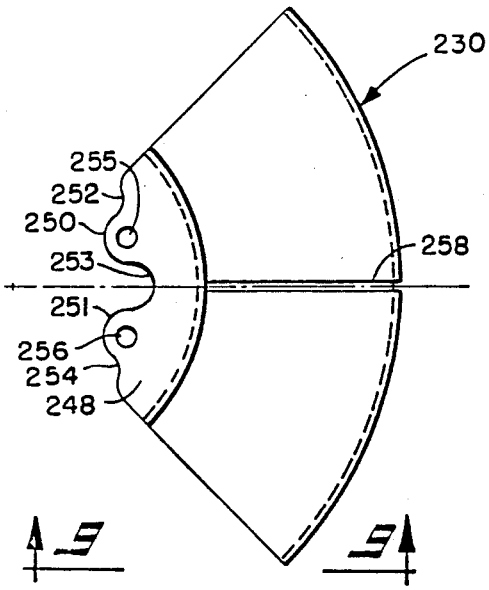
FIG. 8 is an enlarged top plan of a 90° duct enclosure at the leg.
Figure 11:
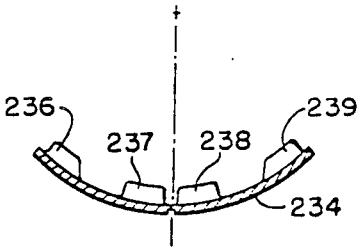
FIG. 11 is a horizontal section taken from the line 11—11 of FIG. 10.
Figure 12:
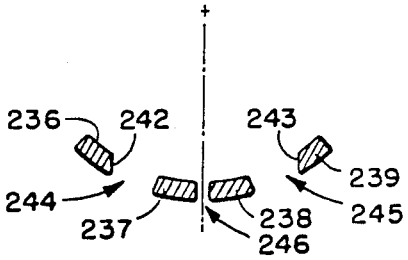
FIG. 12 is a horizontal section taken from the line 12—12 of 10.
Figure 9:
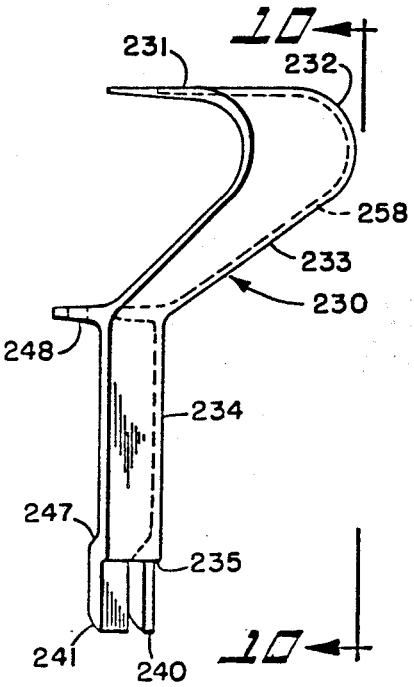
FIG. 9 is a side elevation of the enclosure of FIG. 8 as the line 9—9 thereof.
Figure 10:
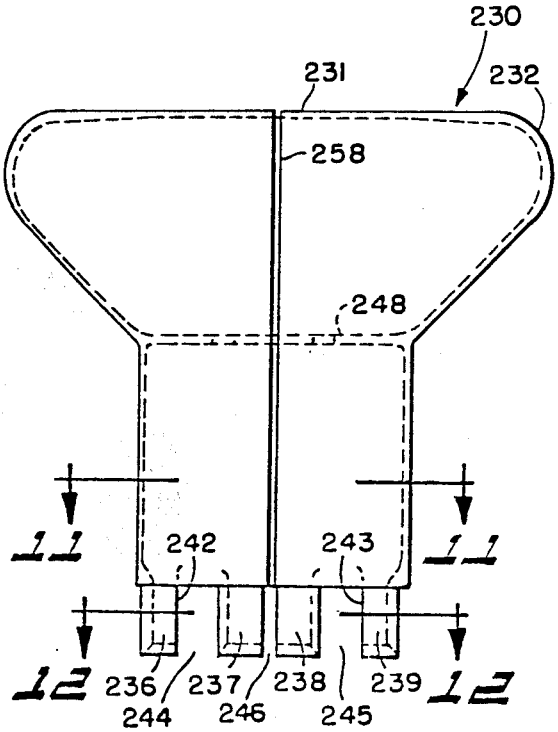
FIG. 10 is a front elevation of the enclosure of FIG. 8 as the line 10—10 of FIG. 9.

Referring now additionally to FIGS. 5 and 6, each beam 40 is a fabricated welded assembly which includes main side plates 150 and 151 seen in FIG. 5 which are bent to the somewhat rounded shape seen at 152 both top and bottom. The plates then extend inwardly recessed from the top and bottom vertical edges as indicated at 153 and are flanged toward each other as seen at 154 and welded together as indicated at 155 and 156. The main frame members of the beam thus form recessed channels both top and bottom of the beam as indicated at 157. The top recess accomodates the housing for the ducts 44 and 46 while both the top and bottom recesses permit covers 159 and 160 to be snapped over the side frames of the beam. The beam frames are also interconnected by transverse flanged rigidifying elements 162. The side frame elements are connected at each end to an end plate 164 to which each clevis 114 is secured. The end plate actually extends between the ears of the clevis with the main vertical portion of the clevis being inside the end plate.

As indicated in FIG. 6, each beam near its end may be provided with a vertically extending wiring duct seen at 166. Each such vertical duct may be formed by welding together the flanged channel-shaped plates 167 and 168. Such vertical duct may extend at one end to the bottom of the duct 44 and at the other end to the bottom of the upper communications duct 46. Such ducts accomodate wiring extending from the floor through the leg enclosures 58 as seen in FIG. 1.

The wiring ducts 44 and 46 are formed from two extrusions seen more clearly in FIG. 5 at 170 and 171. Each extrusion includes a horizontally extending top 172 having an inside screw receiving boss seen at 173 adjacent the edge or opening 174. The top 172 extends to a rounded corner 175 and then through an outwardly inclined sidewall 176 terminating at recess 177. The wall of the extrusion then extends vertically downwardly at 178 and then inwardly at 179 with a screw receiving boss being provided on the interior of the wall 179 as seen at 180. The wall of the extrusion then continues downwardly as seen at 181 to terminate in bottom wall 182. The bottom wall extends both inwardly and outwardly with the outer extension terminating in an upwardly extending hook receiving flange 183 forming with the wall 181 and its upper outer extension 179 a hook receiving channel for accessories. The bottom wall 182 also extends inwardly and is offset upwardly as indicated at 184 to be joined as by welding with the abutting edge of the bottom wall of the opposite extrusion as seen at 185.

Each extrusion also includes a horizontally extending shelf projecting inwardly from the recess 177 as seen at 187 with the abutting edges of the shelves being joined as by welding at 188. The shelves then form a partition between the lower duct 44 and the upper duct 46. The duct forming extrusions are secured to the top of the beam by fasteners not shown.

It can be seen that the upper duct 46 is substantially laterally enlarged as compared to the lower duct 44 and may be provided with lateral access as indicated at 49 or lay-in or top access as provided by the opening between the spaced edges 174. The top opening may be closed by an elongated snap-in cover 189 seen in FIG. 4 which may itself have strategically arranged smaller openings. The lower duct 44 is provided with lateral access only through prewired receptacles not shown in FIG. 5.

As seen by the transverse section of FIG. 5, the stacked ducts one on top of the other provide a laterally enlarged top duct for communications wiring having both lateral and top openings. The enlargement of the duct enables the duct readily to accomodate a substantial volume of communication wiring including rather bulky items such as AMPHENOL connections. The stacked ducts have the general configuration of an enclosed Y with a laterally enlarged stem. The screw bosses 180 and 173 may be employed to secure to the end of the ducts transition or miter joint castings seen at 190 and 191 in FIG. 6. Such transition castings or enclosures may also be secured to the beam through the slotted flanges seen at 192. Such transition enclosures will be used at each end of the beam as the beam is connected to the leg to form with the leg enclosures the continuous ducts through the beams and the legs. The transition castings will also be used at the beam-to-beam connection.

Mid-Beam Connection

Figure 14:
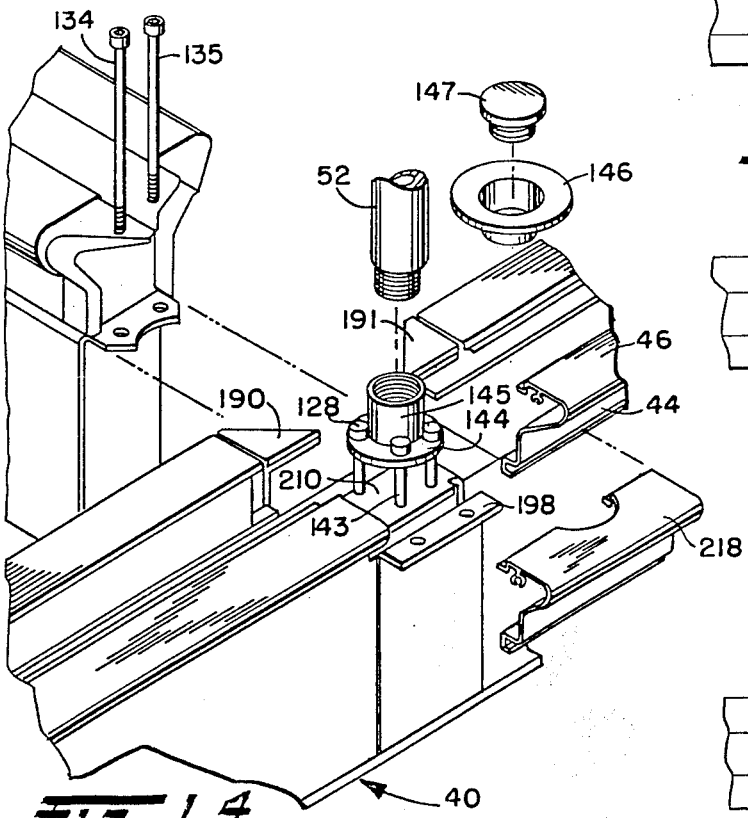
FIG. 14 is an exploded perspective view of the mid-beam connection.

Referring now to FIGS. 5, 6 and 14, it will be seen that each beam at its center is provided with two transverse flanged reinforcing members 195 and 196 to which and between which are connected mid-beam mounting brackets 197 and 198. Such mounting brackets are provided with outturned edge flanges seen at 200 and 201 which are welded to the transverse elements 195 and 196, respectively. Each mounting bracket also includes an outwardly turned top and bottom flange as seen at 202 and 203 in FIG. 5 each provided with a pair of holes seen at 204 and 205. Such holes have the same spacing as the holes in the clevis ears 115 and 116. Such holes are provided in both the top and bottom flanges 202 and 203.

Also secured between the reinforcing elements 195 and 196 is a mounting pad 210 which has downturned flanges 211 and 212 secured to the interior of the reinforcing members 195 and 196, respectively. As indicated, the top surface of the mounting pad is provided with four tapped holes seen at 213. The holes receive the fasteners 128 which extend through the flange 144 of post extension socket 145 and through vertically elongated spacers 143 to form a cage through which the wiring of duct 44 extends at the beam-to-beam junction. The parts forming the cage supporting the post extension are the same as employed in connection with the leg seen in FIG. 3. In addition to the holes 204 and 205 in the mounting bracket flanges, further aligned holes are provided in the beam frame elements so that elongated fasteners 134 and 135 may extend entirely through the edge of the beam. The fasteners are the same as employed in FIG. 3.

To form the mid-beam connection, a section of the duct seen at 218 in FIG. 14 is removed from each side of the beam and a section of the cover may also be removed exposing the holes 219 and 220 in the top of the beam. The transition or miter joint elements of the ducts are then secured in place as seen at 190 and 191. The end of a further beam is then secured to the midpoint of the beam using the fasteners 134 and 135 extending through the end clevis of the further beam. The fasteners simply thread into the bottom ear of the clevis pin connecting and clamping the end of one beam to the midpoint of another. If the post extension 52 is employed in connection with the threaded socket 145, the cap 146 is employed with the hole therein. If not, the cap is closed with the plug or cover 147. It is noted that the cage formed at the mid-beam post extension support is of essentially the same construction as the cage at the beam-leg-connection and the flange 144 of the socket is subjacent the partition formed by the extrusion webs 187 partitioning the ducts through the midpoint connection in the same manner as at the leg.

Leg Enclosures

Figure 13:
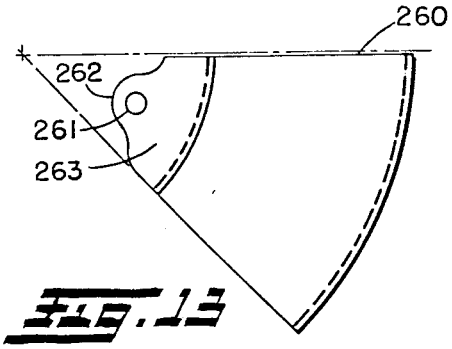
FIG. 13 is a view similar to FIG. 8 of a 45° duct enclosure at the leg.
Figure 24:
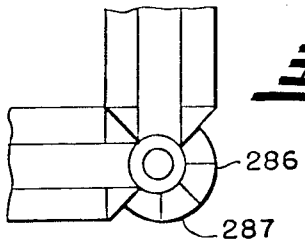
FIGS. 19–24 are fragmentary top plan views of a variety of beam-leg connections which may be employed with the present invention using the enclosure of FIGS. 8–13.

Referring now to FIGS. 8 through 13 it will be seen that the ducts may be enclosed at the leg through the employment of housing sections which may be circular segments of either 90° or 45°. FIGS. 8 through 12 illustrate in detail a 90° segment while FIG. 13 illustrates the 45° segment. The 90° enclosure or casting seen at 230 is a 90° circular segment having a radial section substantially similar to the transverse section of the ducts 46 and 44. The casting includes a top surface 231 with a rounded corner 232 and an outwardly inclined sidewall 233. The sidewall terminates at cylindrical wall 234 which extends cylindrically vertically to exterior shoulder 235.

Projecting below the shoulder is a series of four tines seen at 236, 237, 238 and 239. The lower edge of the tines is relatively sharp as indicated at 240 and the inside lower edge of each tine is provided with a wedge or pilot surface 241. Also, the inner edge of the outer tines 236 and 239 extends substantially chordally as seen at 242 and 243 rather than radially. Also, circumferential spacing between the tines varies significantly with the gaps 244 and 245 being significantly larger than the center gap 246. As seen more clearly in FIG. 9, the tines are somewhat larger than the wall section 234. The inner wall section from the step 247 extends upwardly to shelf 248 which has the profile configuration seen more clearly in FIG. 8.

The profile configuration consists of two semicircular projections 250 and 251 alternating between half recess 252, full recess 253 and half recess 254. The projections 250 and 251 are provided with two fastener receiving holes centered therewith as seen at 255 and 256. The face of the 90° casting or enclosure is provided with an appearance recess 258 which gives the casting the appearance of being two juxtaposed 45° castings or enclosures.

In FIG. 13 there is illustrated a 45° casting or enclosure 260 which is essentially one half of the casting 230. The casting includes a single aperture 261 in the symmetrical projection 262 of the shelf 263. The casting or enclosure may be provided with the feet or tines seen for one half of the casting 230 in FIGS. 11 and 12. In fact, the casting 260 may be formed by simply cutting the casting 230 in half.

Referring back to FIG. 7, it will be seen that the tines or feet of the castings are designed to fit within the exposed recesses 131 in the upper end of the sleeve 103. Thus the enlarged spacings 244 and 245 are designed to accomodate the screw hole bosses while the smaller spacing 246 is designed to accomodate the relatively thinner web 130. The beveled or wedge edges of the tines 241 permit the same to be driven snugly into proper piloted position between the transverse enlargements of the webs 126 and 130 seen at 265. When properly seated in the recesses, the exterior wall 234 is an extension of the exterior of the sleeve 103. The apertures 255 and 256 in the 90° casting and 261 in the 45° casting may be employed with the threaded openings 267 in the flange 144 to secure the casting or housing to such flange with the projecting shelf 248 forming with the flange a partition at the leg between the two vertically superimposed ducts. The recess 253 accomodates the head of the projecting fastener 128.

Referring now to FIGS. 19 through 24, it will be seen that a system of the full and half castings is used to enclose the wiring at the beam connection. The same castings may be used in different combinations for all beam connections.

Figure 19:
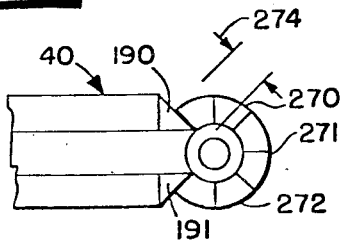

In FIG. 19 or a simple end connection, three castings 230 may be employed as seen at 270, 271 and 272. Such castings will be employed in addition to the miter or transition castings 190 and 191. The end arrangement as seen in FIG. 19 provides a completely enclosed circular enclosure around the post extension above the sleeve of the leg and the lower duct having a radial dimension as seen at 274.

Figure 21:
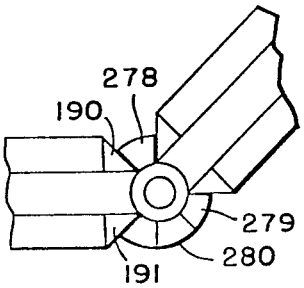
Figure 20:
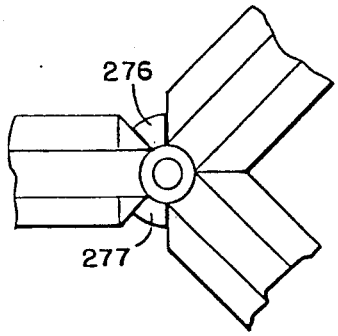

In FIG. 20 two 45° or half castings may be employed as indicated at 276 and 277 to connect the beams as indicated. The two beams at the right of FIG. 20 are 90° to each other and both are 135° from the beam at the left. In the arrnagement of FIG. 21, two half castings or enclosures are employed as seen at 278 and 279 while a full casting is employed at 280 to form the 135° connection shown.

Figure 22:
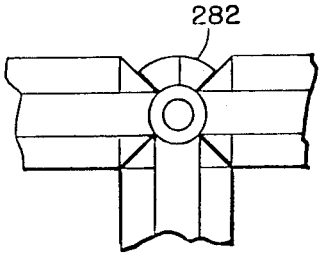

In FIG. 22 one full casting is employed at 282 to form the three-way connection at the leg.

Figure 23:
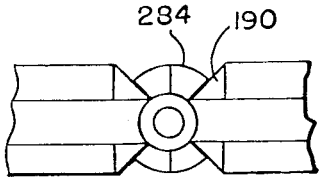

In FIG. 23 for the straight connection shown, two full castings are employed on opposite sides of the leg. For the 90° connection of FIG. 24, two full castings are employed at 286 and 287 together forming a 180° enclosure for the right angle connection shown at the leg. It will be appreciated that two half castings may be employed in lieu of a single full casting. In any event, the central line in the full casting seen at 258 makes all combinations appear to be made up of ⅛ circle components. A four-way connection with beams extending from a single post will use no castings at all but simply the miter or transition castings.

In any event, a fully enclosed duct through the leg is provided both for the power wiring below and the communication wiring above.

Component Mounting Brackets

Referring again to FIG. 5 and additionally to FIGS. 15 and 16, it will be seen that components such as work surfaces, desk tops and the like may be suspended from the beam by use of the mounting brackets seen in FIGS. 5, 15 and 16. As indicated, the top of the structural beam forms a recess 157 in which the extrusions forming the ducts 44 and 46 are situated. The walls 179 and 181 of the duct together with the projecting hook 183 form a recessed hook receiving channel such as seen at 290. The channel extends inwardly and then downwardly from the face of the beam and duct with the undersurface of the wall 179 forming a height restriction in the channel.

A work surface or other accessory 292 is supported on the upper surface of projecting bracket 293 seen in more detail in FIG. 16. The bracket 293 includes a formed metal structure which includes vertically extending triangular sidewalls 294 and 295 connected at the underside of the outer or distal end by web 296 which is provided with a hole for a fastener as seen at 297. The upper edges of the walls are co-planar and provide a mounting surface for a desk top or the like. A formed metal strip 299 is received in the keyways 300 and 301 formed in the upper proximal edge of the projecting bracket and the metal strip is provided with holes 302 also for accomodating fasteners such as screws to secure the top or desk surface 292 thereto. The sidewalls are welded to a vertically extending sleeve 304, the walls of which are provided with a diametrical hole seen at 305.

The sleeve 304 closely fits over tube 308 to slide vertically therealong, such tube also being provided with a series of vertically spaced diametrical holes 309. Welded to the top of the tube 308 is a hook 310. The hook is somewhat triangular in shape and extends from the top of the tube normal to the transverse axis of the holes 309 and along its projecting edge includes a downturned hook flange 311.

On top of the hook 311 there is provided a rotating locking tab 313. The hook is provided with a small aperture 314 and the locking tab includes a locking button 315 which snaps through the aperture 314 to lock the locking tab to the top face of the hook. The locking tab, however, can be rotated about the axis of the tube 308. As seen in FIG. 5, when the locking tab 313 is rotated into the position shown, it acts as a shim between the top of the hook 310 and the underside of the recessed slot formed by the surface 179 thus precluding the hook from being disengaged with the recessed hook receiving channel 290. In order to remove the hook or replace the hook, the locking tab must be rotated out of the way.

The lower end of the tube 308 as seen in FIG. 5 is provided with an adjustable horizontally extending stop or bumper 317 which is mounted on a threaded shank 318 threaded transversely in the tube 308. The projecting end of the shank includes a hex head 320 by which the shank may be rotated to bring the tube 308 to a plum condition. If the work surface 292 is not quite horizontal, the bumper or stop may readily be adjusted to bring the work surface to the desired horizontal position.

The work surface and its supporting bracket 293 are supported on the vertical tube 308 by the employment of the pin seen at 322 in FIG. 16. The pin extends through the holes 305 and the selected aligned holes 309. The pin may be held in place by a cotter pin extending through the transverse hole 323. As indicated in FIG. 1, normally two such bracket assemblies will be employed to support cantilever accessories from the beam. Similar bracket assemblies may be employed to support other accessories such as file cabinets and storage components.

Superstructure Framing

Referring now to FIGS. 17 and 18, it will be seen that each of the post extensions 52 as well as the somewhat larger ceiling ducts 59 may be provided with vertically spaced sets of discs as seen at 325. The disc sets include an upper disc 326 and a lower disc 327 with a spacer 328 therebetween. The discs and spacer are secured to the post extension.

As seen more clearly in FIG. 18, the rails 54 comprise two angles 330 and 331 with the top flanges being co-planar and flat folded beneath themselves as seen at 332 and 333. This provides a somewhat enlarged rounded lateral edge on the rail as indicated at 334 as well as a double thickness closely less than the spacing of the discs. The vertical webs of the angles are slightly horizontally spaced to provide a vertical centerline slot therebetween as seen at 335. The vertical webs are inwardly dimpled at 336 and 337 and the dimples are welded to each other. The vertical slot 335 between the dimples thus extends completely vertically through the hanger bar.

At each upper end of the hanger bar the vertical webs are notched as indicated at 340 and clinched together about a pointed tipped screw 341. In this manner the flat folded top webs fit snugly between the discs 326 and 327 and the set screw 341 is employed to bite into the underside of the lower disc 327 clamping and holding the horizontal rail in place. The flat folded upper webs may be mitered as indicated at 342 so that the rails may extend from the post extension in the same manner in which the beams extend from the legs. Components such as the enclosure or cabinet 76 or 94 may be supported from the rails by hooks 344 secured to the rail in the manner indicated. The hooks include the downwardly extending hook portions on the outer end as seen at 345 and a vertically downwardly extending latching flange as seen at 346 which fits within the slot 335. The upper or channelshape portion of the hook 347 closely conforms to one side of the rail and to be removed it must be lifted vertically.

Exemplary Layouts

As indicated, the beams may come in certain lengths and modules such as 1.83, 2.44 or 3.05 meters which would correspond to 6, 8 and 10 feet, respectively. FIG. 25 illustrates a linear system showing three beams 350, 351 and 352 supported on four posts 353, 354, 355 and 356. Along one side of the beam cantilevered work surfaces are provided at 357 with the square symbols 358 respresenting chairs. On the opposite side of the beam six work stations are also provided which may comprise somewhat smaller cantilevered work surfaces seen at 360 and longer single leg supported work surfaces seen at 361. Because of the ability to vary the height of the work surface with respect to the beam, the smaller cantilevered work surface 360 extends beneath the longer leg supported work surface 361 as seen at 362. In this manner up to 12 work stations of either type may be accomodated along the linear arrangement of three beams.

As seen in FIG. 26, seven beams of an intermediate length such as 2.44 meters are arranged in the octagonal configuration. One side of the octagon is open as seen at 370 and the center may be provided with a conference table as seen at 371. Such arrangement permits a seven person work station with each person working at a relatively long cantilevered desk top seen at 372. Fitting between the longer cantilevered desk tops are special purpose tops 373 which may use the same hook support brackets seen in FIGS. 15 and 16 with one each being secured to contiguous beams. The brackets 293 are secured to the underside of the work surface to extend normal to the respective connecting beam. The enclosed arrangement of FIG. 26 requires eight legs.

In FIG. 27 there is employed three longer beams seen at 376, 377 and 378, two mid-length beams seen at 379 and 380, and two relatively short beams 381 and 382 connected between posts 383 and 384 and the midpoint of the beams 376 and 378, respectively. As indicated, the arrangement may provide a variety of work stations and work surfaces.

In FIG. 29 there is employed a layout using a total of eight relatively short beams to provide a fairly enclosed area seen at 386. Such enclosed area includes four cantilevered work surfaces. The larger work surface 387 extends the entire length of the beam while the two smaller surfaces 388 and 389 are shortened to provide for the additional or fillet work surface 390.

The opposite side of the beams provide alcoves seen at 392 and 393 which may provide either two or three work stations along the cantilevered work surfaces.

FIG. 28 provides a total of eight work stations along opposite sides of the relatively zig-zag configuration of the intermediate length beams seen at 394, 395, 396 and 397. The four beams, of course, require five legs. The work stations may include drawer or storage cabinets seen at 398 and the fillet tables may be of a circular configuration as seen at 399, if desired.

It will be appreciated that the arrangements available are essentially endless.

It can now be seen that there is provided a space divider system having improved horizontal and vertical flexibility and versatility, and with its fully enclosed wiring ducts for both communication and power wiring, provides the necessary wire management for a modern office interior.

Other modes of applying the principles of the invention may be employed, change being made as regards the details described, provided the features stated in any of the following claims or the equivalent of such be employed.

The embodiments of the invention in which an exclusive property or privelege is claimed are defined as follows:

1. A space divider system for office interiors comprising a structural spine and legs supporting said spine at opposite ends thereof, the top of said spine being essentially at work surface height, two enclosed electrical wiring ducts on said spine, one above the other, each at approximately such work surface height, and vertically separated wiring passage means in said legs substantially horizontally aligned and in communication with said enclosed electrical wiring ducts.

2. A space divider system as set forth in claim 1 wherein the lower duct includes outlets on opposite sides thereof.

3. A space divider system as set forth in claim 1 wherein the upper duct includes a lift top cover.

4. A space divider system as set forth in claim 1 wherein said spine is formed of a narrow structural beam with said ducts being positioned on top thereof.

5. A space divider system as set forth in claim 4 wherein said ducts are formed from one or more extrusions.

6. A space divider system as set forth in claim 1 wherein said ducts have the sectional shape of a Y.

7. A space divider system as set forth in claim 1 wherein said ducts have the sectional shape of an enclosed Y with a laterally enlarged stem.

8. A space divider system as set forth in claim 7 wherein the upper edges of the Y are rounded.

9. A space divider system as set forth in claim 1 wherein said spine includes a relatively narrow beam, projections extending from the top and bottom of the opposite ends thereof, said legs including a portion adapted to fit between said projections, and fastener means extending through said projections and into said portion to secure said beam to said leg.

10. A space divider system as set forth in claim 1 wherein said legs include means to connect a spine at any 90° increment therearound, a second spine connected to one of said legs, said vertically separated wiring passage means in said legs providing enclosed electrical continuity for said wiring ducts from spine to spine through the leg to which said spines are both connected.

11. A space divider system as set forth in claim 1 including post means extending from said legs and spine, and an upper structure connected to said post means.

12. A space divider system as set forth in claim 1 wherein said upper structure includes a reticulate frame adapted to support pads, windows, shelves, cabinets and the like, or to form openings.

13. A space divider system as set forth in claim 1 including means to support work tops, cabinets and the like at any position along and projecting from said spine.

14. A space divider system as set forth in claim 1 wherein the upper of said passages in said legs is formed by removable segments.

15. A space divider system as set forth in claim 14 wherein the upper of said ducts is laterally enlarged, and said segments are formed to correspond to the shape of said upper duct.

16. A space divider system for office interiors comprising a structural spine, the top of said spine being essentially at work surface height, two enclosed electrical wiring ducts on said spine, one above the other, at substantially such work surface height, the upper duct being laterally enlarged and accomodating communications wiring while the lower duct accomodates prewired power wiring, legs supporting said spine, and corresponding wiring passages in said legs in communication with said ducts.

17. A space divider system for office interiors comprising a structural spine, the top of said spine being essentially at work surface height, and two enclosed electrical wiring ducts on said spine, one above the other, at substantially such work surface height, the top duct having outwardly inclined sidewalls laterally enlarging the top surface thereof.

18. A space divider system for office interiors comprising a structural spine, the top of said spine being essentially at work surface height, two enclosed electrical wiring ducts on top of said spine, one above the other, each at approximately such work surface height, and legs supporting said spine at opposite ends thereof, said legs including vertically separated access passages for extension of the wiring in said ducts through said legs.

19. A space divider system as set forth in claim 18 wherein said legs includes means to support one or more additional spines extending at increments of 45° from said spine.

20. A space divider system as set forth in claim 19 wherein said top duct is laterally enlarged and includes 45° fillets at the ends of said spine limiting the angle of connection of said additional spines to no less than 90°.

21. A space divider system for office interiors comprising a structural spine, the top of said spine being essentially at work surface height, two enclosed electrical ducts on top of said spine, one above the other, superjacent such work surface height, and legs supporting said spine at opposite ends thereof, said legs including vertically separated access passages for extension of the wiring in said ducts through said legs and means to support one or more additional spines extending at increments of 45° from said spine, said top duct being laterally enlarged and including 45° fillets at the ends of said spine limiting the angle of connection of said additional spines to no less than 90°, and said leg further including segmented circular enclosures corresponding to the laterally enlarged duct forming said access passages.

22. A space divider system as set forth in claim 21 wherein said enclosures extend circularly of the leg in increments of 45°.

23. A space divider system as set forth in claim 22 wherein said fillets and enclosures form a continuation of the enclosed duct to or through said leg.

24. A space divider system for office interiors comprising a structural spine, the top of said spine being essentially at work surface height, two enclosed electrical ducts on top of said spine, one above the other, superjacent such work surface height, legs supporting said spine at opposite ends thereof, said spine including a relatively narrow beam, projections extending from the top and bottom of said beam at each end, said legs each including a portion adapted to fit between respective said projections, and a fastener extending through said projections and said portion to secure said beam to said leg.

25. A space divider system as set forth in claim 24 wherein said portion includes a series of circumferentially spaced vertical holes to accomodate said fastener whereby said beam may be connected to said leg to extend therefrom at the angle dictated by the selected hole.

26. A space divider system as set forth in claim 25 wherein said holes are paired and said beam is secured to said leg by two fasteners.

27. A space divider system as set forth in claim 25 wherein said holes are circumferentially arranged to connect a beam to said leg in increments of 45° about the axis of the leg.

28. A space divider system as set forth in claim 21 wherein said enclosures form a circular opening above said leg, said opening being adapted to accomodate a structural extension of said leg extending through said opening.

29. A space divider system as set forth in claim 28 including a socket for said structural extension which is supported on said leg by an open cage forming one of said access passages through said leg.

30. A space divider system as set forth in claim 29 wherein said structural extension and its socket is of reduced diameter and includes a plate on the lower end thereof, said plate forming a divider between the access passages for the two ducts.

31. A space divider system for interior offices comprising a structural spine, the top of said spine being essentially at work surface height, legs supporting said spine at opposite ends thereof, said spine including a relatively narrow beam, projections extending from the top and bottom of the opposite ends of said beam, said legs each including a portion adapted to fit between said projections, and a fastener extending through said projections and said portion to secure said beam to said leg, said portion being cylindrical and including a series of circumferentially spaced vertical holes to accomodate said fastener whereby said beam may be connected to said leg to extend therefrom at an angle dictated by the selected hole.

32. A space divider system as set forth in claim 31 wherein said holes are circumferentially arranged to connect a beam to said leg in increments of 45° about the axis of the leg.

33. A space divider system as set forth in claim 31 wherein said holes are paired and said beam is secured to said leg by two fasteners.

34. A space divider system for interior offices comprising a structural spine, the top of said spine being essentially at work surface height, legs supporting said spine at opposite ends thereof, said spine including a relatively narrow beam, projections extending from the top and bottom of the opposite ends of said beam, said legs each including a portion adapted to fit between respective said projections, and a fastener extending through said projections and said portion to secure said beam to said leg, said leg further including a vertically extending square post and an enlarged cylindrical sleeve secured to said post, said sleeve including a top surface and a circumferential slot forming said portion adapted to fit between said projections.

35. A space divider system as set forth in claim 34 including means vertically to adjust the height of said sleeve with respect to said post.

36. A space divider system as set forth in claim 34 wherein said fasteners are elongated and extend through the top projection, through the hole in the portion of the leg, and are threaded in the bottom projection to clamp the beam to the leg.

37. A space divider system as set forth in claim 34 including a cage on top of said sleeve supporting a post extension socket, said cage providing wiring access through the leg.

38. A space divider system as set forth in claim 37 including means adjustably vertically supporting the bottom of said cage on the top of said square post.

39. A space divider system as set forth in claim 37 including a reduced diameter post extension threaded in said pocket.

40. A space divider system as set forth in claim 39 including means to secure horizontally extending hanger bars to said post extension.

41. A space divider system as set forth in claim 40 wherein said last mentioned means comprises a disc secured to said post extension, and means to clamp said hanger bar to said disc.

* * * * *